US005688048A

United States Patent [19]

Duckworth

[11] Patent Number: 5,688,048

[45] Date of Patent: Nov. 18, 1997

[54] STIRRER

[76] Inventor: Gary K. Duckworth, 479 Polly Rd., Sunnyvale, Tex. 75182

[21] Appl. No.: 675,941

[22] Filed: Jul. 5, 1996

Related U.S. Application Data

[63] Continuation-in-part of Ser. No. 533,872, Sep. 26, 1995, abandoned.

[51] Int. Cl.[6] ..... B01F 7/32

[52] U.S. Cl. ..... 366/343; 416/227 R; D7/376

[58] Field of Search ..... 366/342, 343, 366/344, 129; D7/669, 688, 690, 376, 380, 378; 416/227 R, 70 R, 69, 76, 77

[56] References Cited

U.S. PATENT DOCUMENTS

| | | | |
|---|---|---|---|
| 26,438 | 12/1859 | Steele . | |
| 36,030 | 7/1862 | Shive | 416/69 |
| 54,134 | 4/1866 | Earle | 416/76 |
| 1,919,101 | 7/1933 | Fitzgerald . | |
| 1,966,352 | 7/1934 | Mahony | D7/380 |
| 2,044,331 | 6/1936 | Rogers | 366/129 |
| 2,208,955 | 7/1940 | Wolff . | |
| 2,243,443 | 5/1941 | Sette | 366/129 |
| 2,621,906 | 12/1952 | Van Guilder . | |
| 2,778,615 | 1/1957 | Hahn | 416/227 |
| 3,319,939 | 5/1967 | Rogenski | 416/227 |
| 3,425,087 | 2/1969 | Fitzhugh | 366/129 |
| 5,417,493 | 5/1995 | Ericson . | |

FOREIGN PATENT DOCUMENTS

| | | | |
|---|---|---|---|
| 619780 | 10/1935 | Germany | 366/129 |

*Primary Examiner*—Tony G. Soohoo
*Attorney, Agent, or Firm*—Stephen R. Greiner

[57] ABSTRACT

A stirrer for mixing mortar, joint compound and other viscous liquids. The stirrer includes a shaft having a fitting at its upper end for insertion into the chuck of a drill motor, or like device, and a pair of blades at its lower end. The blades are formed of stiff metallic strips which intersect each other at their respective midpoints. At their point of intersection, the blades are secured to the lower end of the shaft thereby defining upper blade surfaces adjacent the shaft and lower blade surfaces remote therefrom. The ends of the blades are provided with a semicircular shape and the lower blade surfaces adjacent thereto are secured to the shaft at a point remote from its lower end.

12 Claims, 1 Drawing Sheet

STIRRER

CONTINUING APPLICATION INFORMATION

This application is a continuation-in-part of the application, Ser. No. 08/533,872, filed Sep. 26, 1995, now abandoned.

FIELD OF THE INVENTION

The present invention relates generally to agitating apparatus and, in particular, to a rotatable stirrer for positioning within a stationary mixing chamber.

BACKGROUND OF THE INVENTION

The mixing and blending of viscous liquids such as mortar and joint compound has long been accomplished by motor-driven stirring tools. Typically, these tools have comprised a paddle with a central shaft rotatively secured within the chuck of a conventional drill motor. While such tools are capable of yielding mixed liquid products of homogeneous consistency, they have, up to the present time, never been particularly efficient or safe.

Mortar, joint compound and the like are usually mixed within buckets or other cylindrical, flat-bottomed containers. When the paddle of a conventional stirring tool is rotated within the liquid product filling such a container, centrifugal force tends to transform the planar, horizontal surface of the liquid product into a vortex or whirlpool around the centrally-located, vertical axis of the paddle. Since the conventional paddle has either a horizontal or upwardly sloping surface at the point where it connects to the rotatable shaft, a portion of the paddle is often not submerged in the liquid product during mixing.

Because the conventional paddle is not fully in contact with the liquid product, additional time and energy is required to bring it to a homogeneous consistency. Furthermore, the exposed, upper edges of the paddle offer an opportunity for inadvertent contact and injury to users. Splattering of liquid product is also an ever present problem.

SUMMARY OF THE INVENTION

In light of the problems associated with the known tools for mixing and blending viscous liquids, it is a principal object of the present invention to provide a rotatable stirrer with at least one high-efficiency mixing blade which, during use, will rapidly churn a liquid and tend to remain submerged therein so as to reduce splattering and the likelihood of injury to users.

Briefly, the preferred stirrer in accordance with this invention achieves the intended objects by featuring a shaft having a fitting at its upper end for insertion into the chuck of a drill motor and a pair of mixing blades at its lower end. The blades are secured in a crossed relationship to the lower end of the shaft thereby defining upper surfaces adjacent the shaft and lower surfaces remote therefrom. The end portions of the strips are provided with a semicircular shape and the lower surfaces are secured by welding to the shaft at a point between the upper and lower ends thereof.

While mixing a liquid, it has been found that the semicircular portions of the blades induce the formation of a turbulent vortex or whirlpool around the stirrer at relatively low rotation speeds. After a vortex has been formed, the downward slope of the semicircular portions toward the shaft assists in retaining the blades beneath the surface of the vortex itself. Mixing, thus, proceeds at a rapid rate without splashing.

By forming the shaft and mixing blades of the preferred stirrer out of metal, such may be readily welded together using conventional techniques to provide a stirrer for the purposes described which is lightweight, inexpensive, durable and fully effective in accomplishing its intended purposes.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Referring now to FIGS., a stirrer in accordance with the present invention is shown at 10. The stirrer 10 includes an elongated shaft 12 having an hexagonal fitting 14 at its upper end for insertion into the chuck of a drill motor, or like device (not shown). A pair of mixing blades 16 and 18 are secured to the lower end of the shaft 12 so that their general planes of extent are at right angles to one another.

Figure 1:
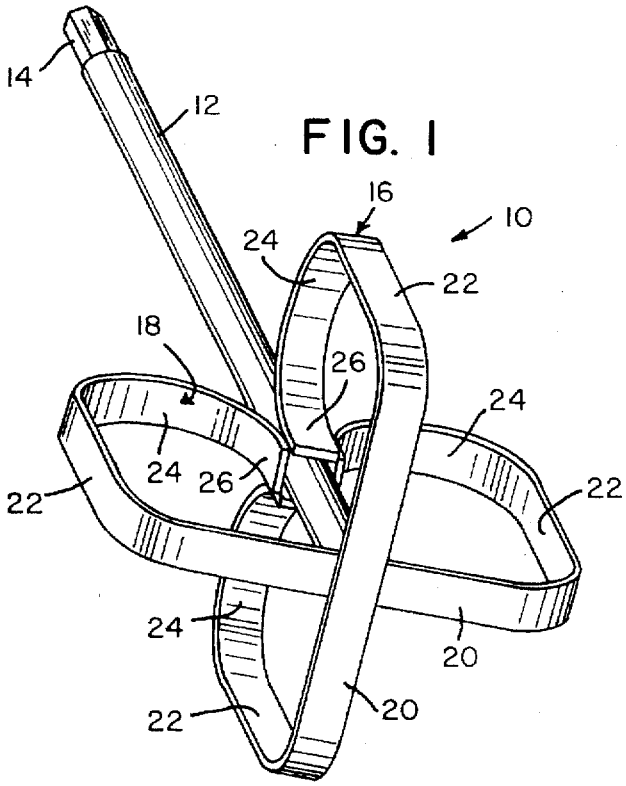
FIG. 1 is a perspective view of a stirrer in accordance with the present invention.
Figure 2:
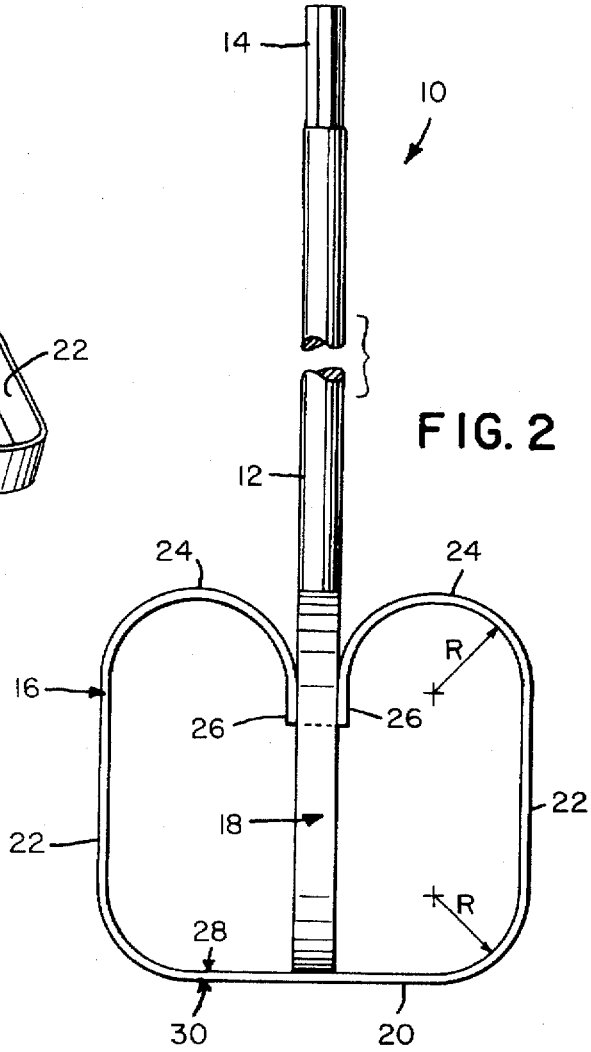
FIG. 2 is a side elevational view of the stirrer of FIG. 1.
Figure 3:
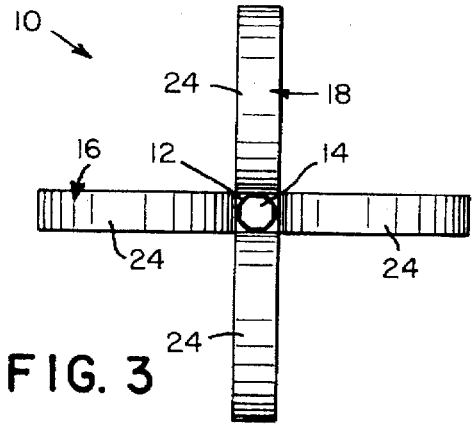
FIG. 3 is a top view of the stirrer.
Figure 4:
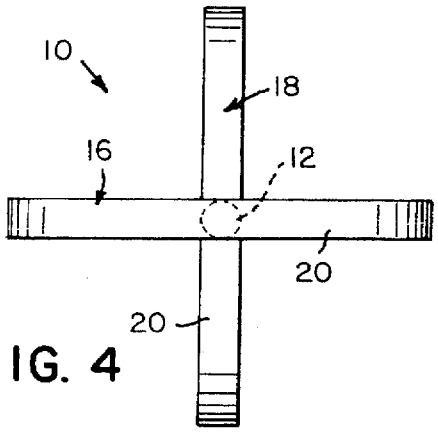
FIG. 4 is a bottom view of the stirrer.

Each of the mixing blades 16 and 18 comprises a strip of stiff metal bent or otherwise formed into a substantially closed configuration. This configuration is perhaps best illustrated in FIG. 2, wherein one of the blades 16 is shown to include a generally flat bottom portion 20 having a pair of integral side portions 22 extending upwardly therefrom. Each of the side portions 22 is integrally connected at its respective top to a semicircular portion 24 formed by turning the opposed ends 26 of the blade 16 inwardly so as to yield an appending loop having an inner radius "R".

The base portions 20 of blades 16 and 18 are welded in a crossed relationship to the lower end of the shaft 12 so as to define upper blade surfaces 28 adjacent the shaft and lower blade surfaces 30 remote therefrom. Proximate the opposed ends 26 of the blades 16 and 18 it is the lower blade surfaces 30 that are secured by welding directly to the shaft 12 at a point between the upper and lower ends thereof.

Although a stirrer embodying the present invention may be constructed in any desired size and any suitable materials, the preferred embodiment is relatively large for mixing and blending large quantities of mortar or joint compound. The shaft 12 comprises a steel rod 18" long and ½" in diameter. The flats across the hexagonal fitting 14 at the upper end of the shaft 12 are ⅜" wide. The blades 16 and 18, on the other hand, are steel sheet approximately ½" wide and ⅛" thick. After assembly, the stirrer 10 may be nickel plated to inhibit corrosion and permit easy clean-up after use.

To use the stirrer 10 for mixing and blending a liquid, a user first engages the hexagonal fitting 14 of the shaft 12 with the chuck of a drill motor. The blades 16 and 18 of the stirrer are then submerged within the liquid and the drill motor is energized. The semicircular portions 24 of the blades encourage the formation of a vortex in the liquid yielding rapid mixing and blending of any unsuspended material therein. When a homogeneous consistency is achieved, the drill motor may be deenergized. The stirrer is then withdrawn from the liquid, rinsed, and stored for later use.

While the invention has been described with a high degree of particularity, it will be appreciated by those skilled in the art that numerous modifications and substitutions may be made thereto. For example, any desired number of mixing blades may be secured to the rotatable shaft. Therefore, it is to be understood that the present invention is not limited to the sole embodiment described above, but encompasses any and all embodiments within the scope of the following claims.

I claim:

1. A stirrer, comprising:

a shaft having a upper end and a lower end;

a first blade formed from an elongated strip of material having opposed ends, an upper surface and a lower surface;

said lower end of said shaft being secured to said upper surface of said first blade; and, said lower surface of said first blade, proximate said opposed ends thereof, being secured to said shaft remote from said lower end.

2. The stirrer according to claim 1 wherein said lower end of said shaft is secured to said first blade midway between said opposed ends thereof.

3. The stirrer according to claim 1 wherein:

said lower end of said shaft is welded to said upper surface of said first blade; and, said lower surface of said first blade, proximate said opposed ends thereof, is welded to said shaft remote from said lower end.

4. The stirrer according to claim 1 further comprising a second blade carried by said shaft, said second blade being formed from an elongated strip of material having opposed ends, a upper surface and a lower surface.

5. The stirrer according to claim 4 wherein:

said first blade and said second blade intersect one another at right angles adjacent said lower end of said shaft;

said upper surface of said second blade is secured to said lower surface of said first blade at their point of intersection; and, said lower surface of said second blade, proximate said opposed ends thereof, is secured to said shaft remote from said lower end.

6. The stirrer according to claim 1 wherein said upper surface of said second blade is welded to said lower surface of said first blade at their point of intersection and said lower surface of said second blade, proximate said opposed ends thereof, is welded to said shaft remote from said lower end.

7. A stirrer, comprising:

a shaft having an upper end and a lower end;

a first elongated strip having opposed ends, said first elongated strip being secured at a point midway between the opposed ends thereof to said lower end of said shaft, the opposed ends of said first elongated strip being turned inwardly upon themselves to form a pair of first appending loops adjacent said shaft, and the opposed ends of said first elongated strip being secured to said shaft remote from the lower end thereof; and, each of said first appending loops including: a flat bottom portion extending orthogonally from said shaft, a flat side portion extending parallel to said shaft, and two curved portions with the same radius of curvature connecting, respectively, the top and bottom of said flat side portion to said shaft and said flat bottom portion.

8. The stirrer according to claim 7 further comprising a second elongated strip intersecting said first elongated strip at right angles adjacent said lower end of said shaft, said second elongated strip having opposed ends, said second elongated strip being secured at a point midway between the opposed ends thereof to said lower end of said shaft, the opposed ends of said second elongated strip being turned inwardly upon themselves to form a pair of second appending loops adjacent said shaft, and the opposed ends of said second elongated strip being secured to said shaft remote from the lower end thereof, and each of said second appending loops including: a second flat bottom portion extending orthogonally from said shaft, a second flat side portion extending parallel to said shaft, and two second curved portions with the same radius of curvature connecting, respectively, the top and bottom of said second flat side portion to said shaft and said second flat bottom portion.

9. The stirrer according to claim 8 wherein said shaft and said first elongated strip are each formed of a metallic composition and are secured together by welding.

10. A stirrer, comprising: a shaft having an upper end and a lower end; and, a first mixing blade including:

a first bottom portion secured to said lower end of said shaft, said first bottom portion being flat and oriented orthogonally to said shaft, said first bottom portion having opposed ends each being located a first predetermined distance from said shaft;

a pair of first side portions integral with said first bottom portion, each of said first side portions extending upwardly from one of said opposed ends of said first bottom portion, each of said first side portions having a flat segment oriented parallel to said shaft and located at twice said first predetermined distance from said shaft; and, a pair of first semicircular portions integral with said pair of first side portions, each of said first semicircular portions connecting the top of one of said first side portions with said shaft at a point remote from the lower end thereof.

11. The stirrer according to claim 10 further comprising a second mixing blade including:

a second bottom portion secured to said lower end of said shaft, said second bottom portion being flat and oriented orthogonally to said shaft, said second bottom portion having opposed ends each being located a second predetermined distance from said shaft;

a pair of second side portions integral with said second bottom portion, each of said second side portions extending upwardly from one of said opposed ends of said second bottom portion, each of said second side portions having a flat segment oriented parallel to said shaft and located at twice said second predetermined distance from said shaft; and, a pair of second semicircular portions integral with said pair of second side portions, each of said second semicircular portions connecting the top of one of said second side portions with said shaft at a point remote from the lower end thereof.

12. The stirrer according to claim 11 wherein said shaft, said first mixing blade and said second mixing blade are each formed of a metallic composition and said first mixing blade and said second mixing blade are secured to said shaft by welding.

* * * * *